US007832827B2

(12) United States Patent
Taira

(10) Patent No.: US 7,832,827 B2
(45) Date of Patent: Nov. 16, 2010

(54) INKJET HEAD

(75) Inventor: Hiroshi Taira, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 530 days.

(21) Appl. No.: 11/864,491

(22) Filed: Sep. 28, 2007

(65) Prior Publication Data

US 2008/0079782 A1 Apr. 3, 2008

(30) Foreign Application Priority Data

Sep. 29, 2006 (JP) ..... 2006-268136

(51) Int. Cl.
*B41J 2/015* (2006.01)

(52) U.S. Cl. ..... 347/20; 347/54; 347/68; 347/70; 347/71; 347/92; 347/93; 347/108

(58) Field of Classification Search ..... 347/20
See application file for complete search history.

(56) References Cited

U.S. PATENT DOCUMENTS

| | | | | |
|---|---|---|---|---|
| 5,581,288 | A * | 12/1996 | Shimizu et al. | 347/87 |
| 2004/0109046 | A1* | 6/2004 | Taira | 347/68 |
| 2004/0119790 | A1* | 6/2004 | Taira | 347/68 |
| 2005/0030349 | A1* | 2/2005 | Taira | 347/68 |
| 2005/0140754 | A1* | 6/2005 | Hirota et al. | 347/85 |
| 2005/0157104 | A1* | 7/2005 | Hirota et al. | 347/85 |
| 2006/0071959 | A1* | 4/2006 | Ito et al. | 347/9 |
| 2006/0103700 | A1* | 5/2006 | Taira | 347/85 |

FOREIGN PATENT DOCUMENTS

| | | | |
|---|---|---|---|
| JP | H10-202070 | A | 8/1998 |
| JP | H10-250053 | A | 9/1998 |
| JP | 2000-002213 | A | 1/2000 |
| JP | 2005169839 | A | 6/2005 |
| JP | 2005-246903 | A | 9/2005 |
| JP | 2006-103117 | A | 4/2006 |
| JP | 2006-205633 | A | 8/2006 |
| JP | 2006-256222 | A | 9/2006 |

OTHER PUBLICATIONS

Japanese Patent Office, Notice of Reasons for Rejection for Japanese Patent Application No. 2006-268136 (counterpart to above-captioned patent application), mailed Dec. 2, 2008.

Japanese Patent Office, Notice of Reasons for Rejection for Japanese Patent Application No. 2006-268136 (counterpart to above-captioned patent application), mailed Aug. 19, 2008.

* cited by examiner

*Primary Examiner*—Ryan Lepisto
(74) *Attorney, Agent, or Firm*—Baker Botts L.L.P.

(57) ABSTRACT

An inkjet head has a flow path unit having a first surface and a second surface opposite the first surface. The flow path unit ejects ink in an ink ejection direction. The flow path unit has wall plates positioned on the second surface, extending away from the flow path unit. The inkjet head has a cover contacting at least one of the wall plates. The cover covers a portion of the second surface, and the cover has sidewalls. A first portion of at least one of the sidewalls contacts a first portion of corresponding wall plates, and a second portion of at least one of the sidewalls and a second portion of the corresponding wall plates defines a gap between them. The inkjet head has a seal positioned in the gap, and the seal prevents fluid from entering the gap.

11 Claims, 5 Drawing Sheets

INKJET HEAD

CROSS REFERENCE TO RELATED APPLICATION

This application claims priority to and the benefit of Japanese Patent Application No. 2006-268136, filed Sep. 29, 2006, the entire disclosure of which is incorporated herein by reference.

BACKGROUND OF THE INVENTION

1. Field of the Invention

The invention relates to an inkjet head that ejects ink droplets onto a recording medium for printing.

2. Description of Related Art

A known inkjet head for ejecting ink droplets onto a recording sheet includes a flow path unit and an actuator. The flow path unit includes individual ink paths connecting common ink chambers, pressure chambers and nozzles. The actuator is configured to apply energy, which is required for ejecting ink droplets from the nozzles, to the pressure chambers. The actuator may be made by interposing a piezoelectric layer made of a lead zirconium titanate (PZT)-based ceramic material having ferroelectric properties between a group of individual electrodes provided in association with the nozzles, and a common electrode to which grand potential is applied. In the actuator, individual electrodes disposed on a surface may be short-circuited due to adhesion of ink mist, thus degrading printing quality and speed. A sealing agent is used to prevent ink mist from entering the inkjet head. However, it is difficult to apply the sealing agent uniformly and fully. Thus, the sealing agent may peel off and ink mist may enter the inkjet head.

SUMMARY OF THE INVENTION

An embodiment of the invention provides an inkjet head that reliably prevents ink mist from entering the inkjet head. In an embodiment of the invention, parts needed to reliably prevent ink mist from entering the inkjet head may be manufactured without complex manufacturing procedures, thus reducing the cost of manufacturing the inkjet head.

According to an embodiment of the invention, an inkjet head inkjet head comprises a flow path unit comprising a first surface and a second surface opposite the first surface, in which the flow path unit is configured to eject ink in an ink ejection direction, an actuator positioned on the second surface, in which the actuator is configured to generate ejection energy for ejecting ink, a plurality of wall plates positioned on the second surface and extending away from the flow path unit in a direction opposite from the ink ejection direction, a covering member contacting at least one of the plurality of wall plates, in which the covering member is configured to cover a portion of the second surface of the flow path unit, and the covering member comprises a plurality of sidewalls, in which a first portion of at least one of the plurality of sidewalls contacts a first portion of a corresponding one of the plurality of wall plates, and a second portion of the at least one of the plurality of sidewalls and a second portion of the corresponding one of the plurality of wall plates defines a gap therebetween, and a seal positioned in the gap, wherein the seal is configured to prevent fluid from entering the gap.

Thus, the gap is filled with the sealing agent, so that the sidewall of the covering member and the wall plates adhere to each other tightly and stably. This structure prevents ink mist from entering the ink jet head. In addition, this structure prevents the sealing agent from squeezing out, so that the sides of the ink jet head are resistant to dirt.

According to an embodiment of the invention, the gap extends along an entire length of a boundary between each wall plate and the corresponding sidewall. Thus, the sidewall of the covering member and the wall plates adhere to each other more tightly.

According to an embodiment of the invention, the seal extends through the entire gap. Thus, the sidewall of the covering member and the wall plates adhere to each other more tightly.

According to an embodiment of the invention, the second portion of the at least one of the plurality of sidewalls comprises a recess which defines at least a portion of the gap. Thus, the gap may be formed simply thereby reducing cost of the inkjet head.

According to an embodiment of the invention, the second portion of the at least one of the plurality of wall plates comprises a recess which defines at least a portion of the gap. Thus, the gap may be formed simply thereby reducing cost of the inkjet head.

According to an embodiment of the invention, the second portion of the at least one of the plurality of wall plates comprises a first recess, and the second portion of the at least one of the plurality of sidewalls comprises a second recess, wherein the first and second recesses define at least a portion of the gap. Thus, the gap may be formed simply thereby reducing cost of the inkjet head.

According to an embodiment of the invention, at least one of the plurality of wall plates is a heat sink configured to transfer heat to the outside of the at least one of the plurality of wall plates. Thus, the plurality of wall plates transfer heat to the outside of the at least one of the plurality of wall plates.

According to an embodiment of the invention, the heat sink comprises aluminum metal, titanium metal, magnesium metal, stainless steel, or a titanium or magnesium alloy metal. Thus, the heat sink transfers heat to the outside of the heat sink efficiently.

According to an embodiment of the invention, the seal is positioned in the gap and held in place by capillary action. Thus, the seal is easily charged into all the way to the gap.

According to an embodiment of the invention, the seal comprises a material having a viscosity of 5-20 pascals per second. Thus, the seal is easily charged into all the way to the gap.

According to an embodiment of the invention, the first portion of the at least one side wall is larger than the second portion of the at least one sidewall.

According to an embodiment of the invention, the first portion of the at least one side wall is smaller than or the same size as the second portion of the at least one sidewall.

BRIEF DESCRIPTION OF THE DRAWINGS

For a more complete understanding of embodiments of the present invention, needs satisfied thereby, and the objects, features, and advantages thereof, reference now is made to the following description taken in connection with the accompanying drawings.

DETAILED DESCRIPTION OF PREFERRED EMBODIMENTS

Preferred embodiments of the present invention, and their features and advantages, may be understood by referring to FIGS. 1-5, like numerals being used for corresponding parts in the various drawings.

Figure 1:
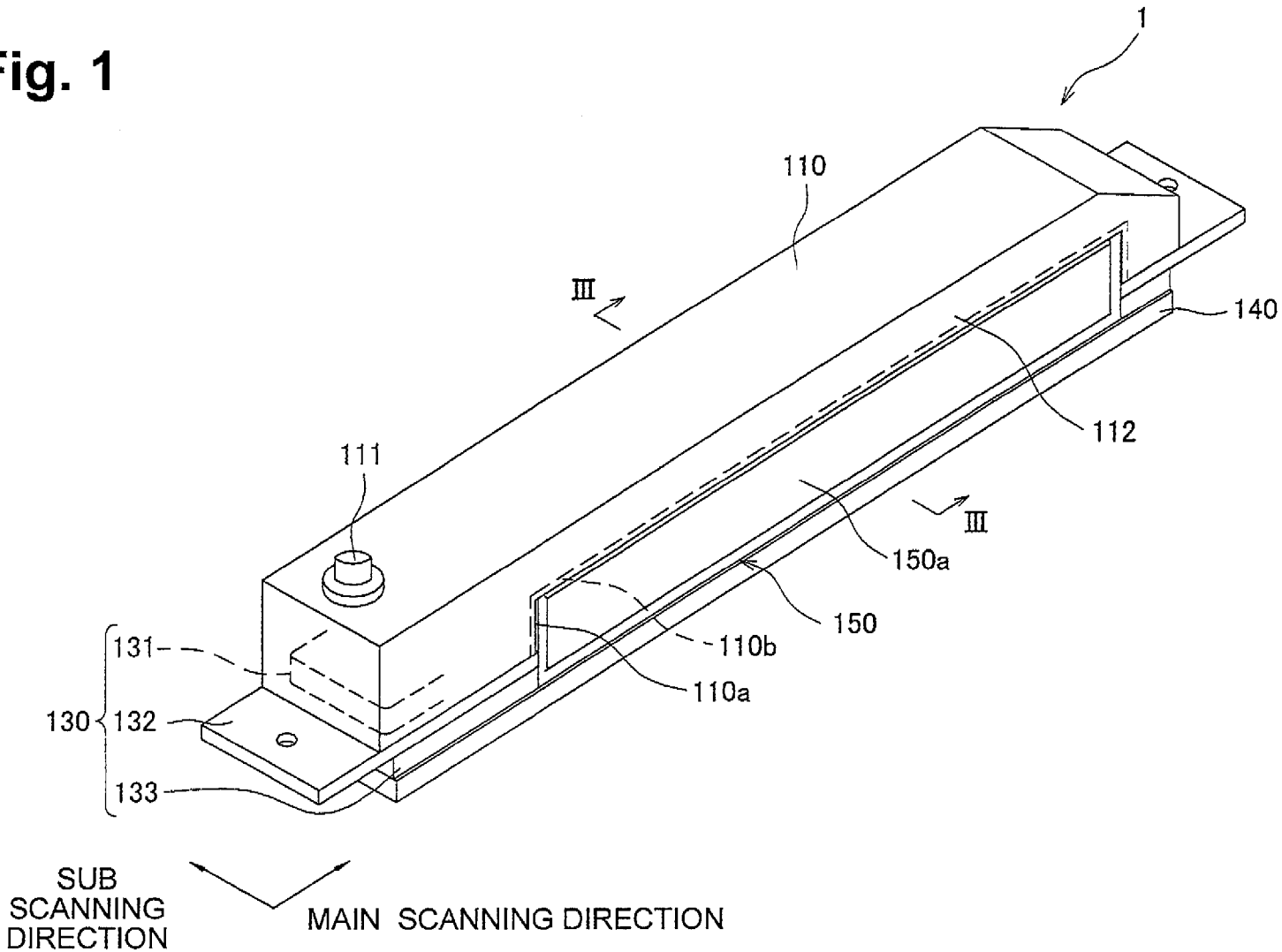
FIG. 1 is a perspective view of an inkjet head, according to an embodiment of the invention.

An inkjet head 1 according to an embodiment of the invention is shown in FIG. 1. Inkjet head 1 may be elongated in one direction, and may be applied to an inkjet-type image recording apparatus such as an inkjet printer.

Inkjet head 1 may be disposed in the recording apparatus in a direction facing a recording medium, hereinafter interchangeably referred to as a recording sheet, e.g., a sheet of plain paper or a transparency. The recording sheet may be fed by a feed mechanism. Inkjet head 1 may have a rectangular parallelepiped shaped line head, whose longitudinal direction may be set in a main scanning direction. The feed mechanism may include a conveyor belt and may be configured to feed a recording sheet, fed from a supply mechanism, on the conveyor belt to an area facing inkjet head 1. Inkjet head 1 may have a printing area extending across substantially the full width of the conveyor belt. A plurality, e.g., four, inkjet heads may be provided in the recording apparatus parallel to a direction in which a recording sheet is fed (hereinafter refereed to as a sheet feeding direction). Each inkjet head 1 may eject ink droplets of a different color, e.g., one each of yellow, cyan, magenta, and black, thereby enabling color printing. Based on externally transmitted image data, the feed mechanism may feed a recording sheet to an opposed position of each inkjet head 1, and each inkjet head 1 may eject ink droplets onto the recording sheet to form an image. The recording sheet on which the image has been formed further may be fed and stored in a sheet ejection portion.

In an embodiment of the invention, the main scanning direction may be defined as a lengthwise, or long, direction of the inkjet head in a plan view, while a sub scanning direction may be defined as a direction perpendicular to the main scanning direction in a horizontal axis, when viewed in a plan view. The direction in which ink droplets may be ejected from the inkjet head 1 may herein be interchangeably referred to as the bottom, downward, or down direction, and the direction opposite the bottom direction may herein be interchangeably referred to as the top, upward, or up direction.

Figure 2:
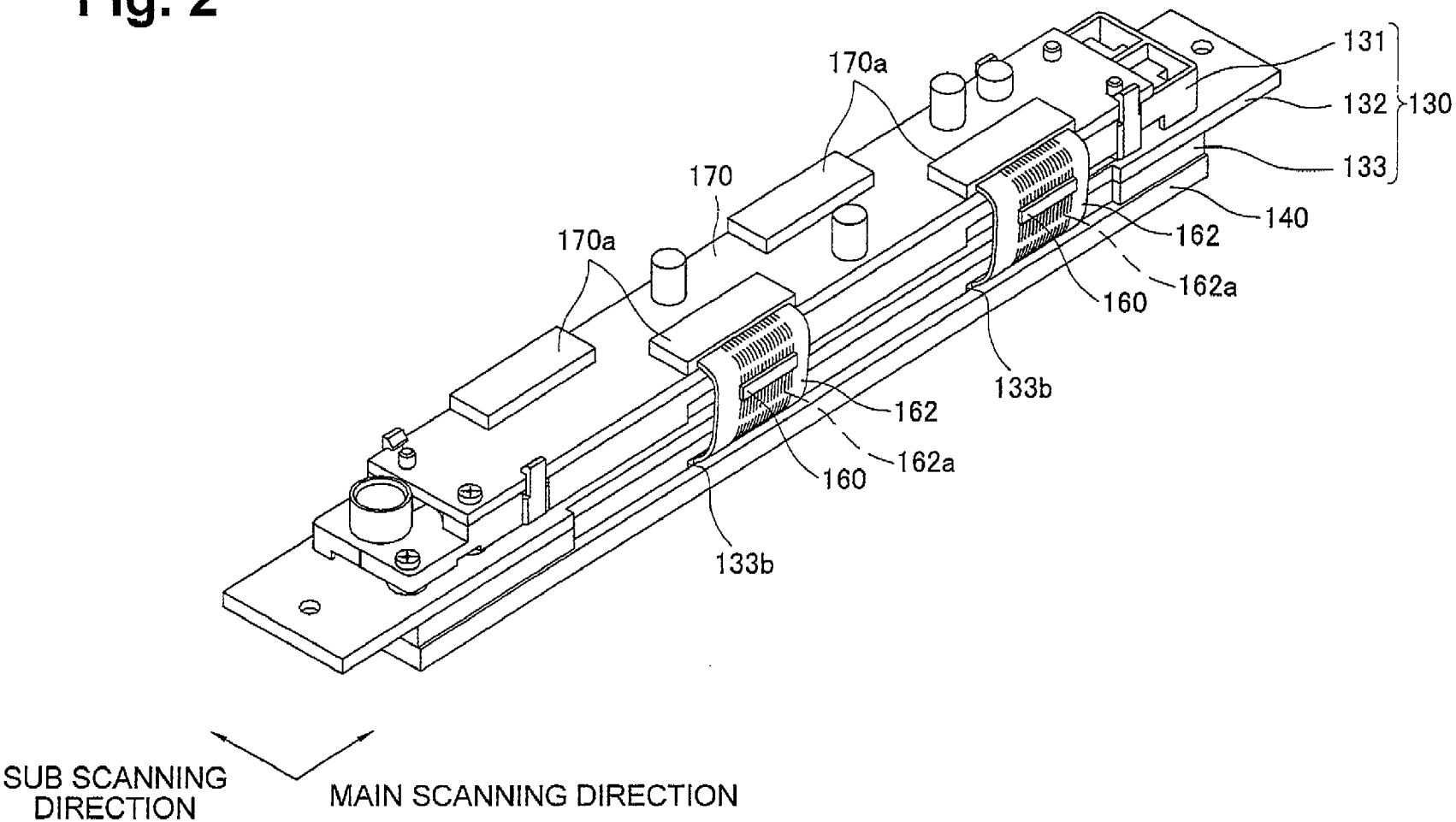
FIG. 2 is a perspective view showing an internal structure of the inkjet head shown in FIG. 1.
Figure 3:
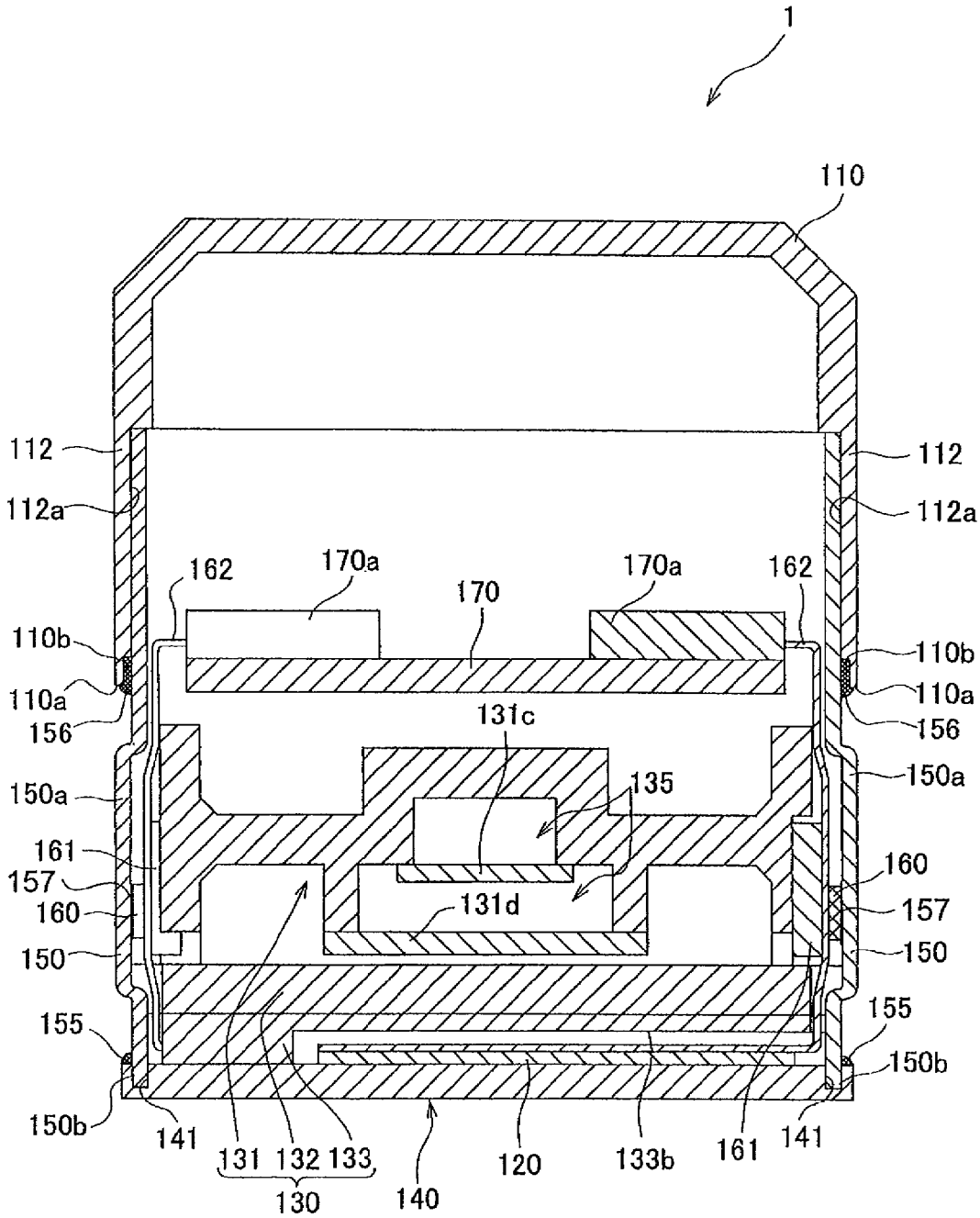
FIG. 3 is a cross-sectional view of the inkjet head taken along a line III-III of FIG. 1, according to an embodiment of the invention.

As shown in FIGS. 1 to 3, inkjet head 1 may include a flow path unit 140, an ink reservoir 130, a covering member, e.g., a head cover 110, side plates, e.g., heat sinks 150, and a control circuit board 170. Flow path unit 140 may include nozzles on a bottom surface, e.g., an ejection surface, and ink reservoir 130 may be configured to supply ink to flow path unit 140. Control circuit board 170, ink reservoir 130, and flow path unit 140 may be laminated from top to bottom in this order.

Inside flow path unit 140, ink paths, e.g., a common ink chamber and individual flow paths connecting the common ink chamber and nozzles via pressure chambers, may be formed. A plurality, e.g., four, of actuator units 120 may be mounted on an upper surface e.g., a mounting surface of flow path unit 140. Each actuator unit 120 may be configured to selectively apply ejection energy to ink in the pressure chambers, so as to eject ink droplets from the nozzles of flow path unit 140 in an ink ejection direction. Actuator unit 120 may be a unimorph-type, that is, a piezoelectric layer may be interposed between a common electrode and a number of individual electrodes may be disposed to face the corresponding pressure chambers. The piezoelectric layer may be made of a lead zirconium titanate (PZT)-based ceramic material having ferroelectric properties. The individual electrodes and the common electrode may be made of, e.g., an Ag—Pd-based metallic material. The individual electrodes may be electrically connected to corresponding wiring patterns 162*a* on Flexible Printed Circuits (FPCs) 162 on an upper surface of actuator unit 120, via lands which may be made of gold mixed with glass frit. When a predetermined voltage pulse may be applied from a driver IC 160 to an individual electrode via a corresponding wiring pattern 162*a* on FPC 162, an area on actuator unit 120 corresponding to the individual electrode may be deformed, and a volume of the pressure chamber facing the area may vary. In this manner, ejection energy, e.g., a pressure wave, may be generated in ink in the pressure chamber, and an ink droplet may be ejected from the corresponding nozzle.

As shown in FIGS. 2 and 3, control circuit board 170 may be configured to control actuator units 120, and may be fixed in an upper part of ink reservoir 130. A plurality, e.g., four, of connectors 170*a* may be fixed on an upper surface of control circuit board 170. Connectors 170*a* may be electrically connected to devices built on control circuit board 170, e.g., processors and storage devices.

One end of each FPC 162 may be electrically connected to a side of each connector 170*a*. FPC 162 may be a flexible sheet on which wiring patterns 162*a* may be formed and driver IC 160 may be mounted. The other end of each FPC 162, which may be terminals of wiring patterns 162*a*, may be inserted into a recessed portion 133*b* of ink reservoir 130 and may be electrically connected to individual electrodes of actuator unit 120.

Driver IC 160 may be an IC chip configured to drive actuator unit 120. As shown in FIG. 3, each driver IC 160 may be urged against FPC 162 and heat sink 150 by a sponge 161 disposed on a side of ink reservoir 130. Heat sinks 150 may be metal plates made of metal, e.g., aluminum. A heat dissipation sheet 157 may be affixed to an inner surface of each heat sink 150, at a position facing driver IC 160. As driver IC 160 tightly contacts heat sink 150 via heat dissipation sheet 157, driver IC 160 and heat sink 150 may become thermally coupled. Thus, a heat generated in driver IC 160 may be dissipated via heat sink 150.

Ink reservoir 130 may include an upper reservoir 131, a reservoir base 132, and a lower reservoir 133, which may be disposed in this order in a direction leading toward flow path unit 140. An ink path 135 may be formed inside upper reservoir 131. Ink path 135 may be in fluid communication with an ink supply valve 111. In addition, ink path 135 may be in fluid communication with flow path unit 140 via an ink path (not shown) formed in reservoir base 132. A part of a lower surface of ink path 135 may be defined by a flexible film 131*d*. A lower surface of flexible film 131*d* faces reservoir base 132 via a gap, and may be movable within the gap. Thus, when film 131*d* vibrates, film 131*d* may absorb the impact generated by a pressure wave in ink filled in ink path 135. A filter 131*c* having minute holes may be disposed in ink path 135.

As shown in FIGS. 2 and 3, lower reservoir 133 may be bonded to flow path unit 140 and recessed portion 133*b* may be partially formed between lower reservoir 133 and flow path unit 140. Referring to FIG. 3, a recessed portion 133*b* may be positioned corresponding to each actuator unit 120. Each actuator unit 120 may be attached to the surface of flow path unit 140, in a gap formed by recessed portion 133*b*. Ink supply valve 111 may supply ink to flow path unit 140 through ink path 135 formed in ink reservoir 130. Before ink reaches flow path unit 140, ink passes through filter 131*c* positioned in ink path 135, so that filter 131*c* may filter the impurities from ink.

Figure 4:
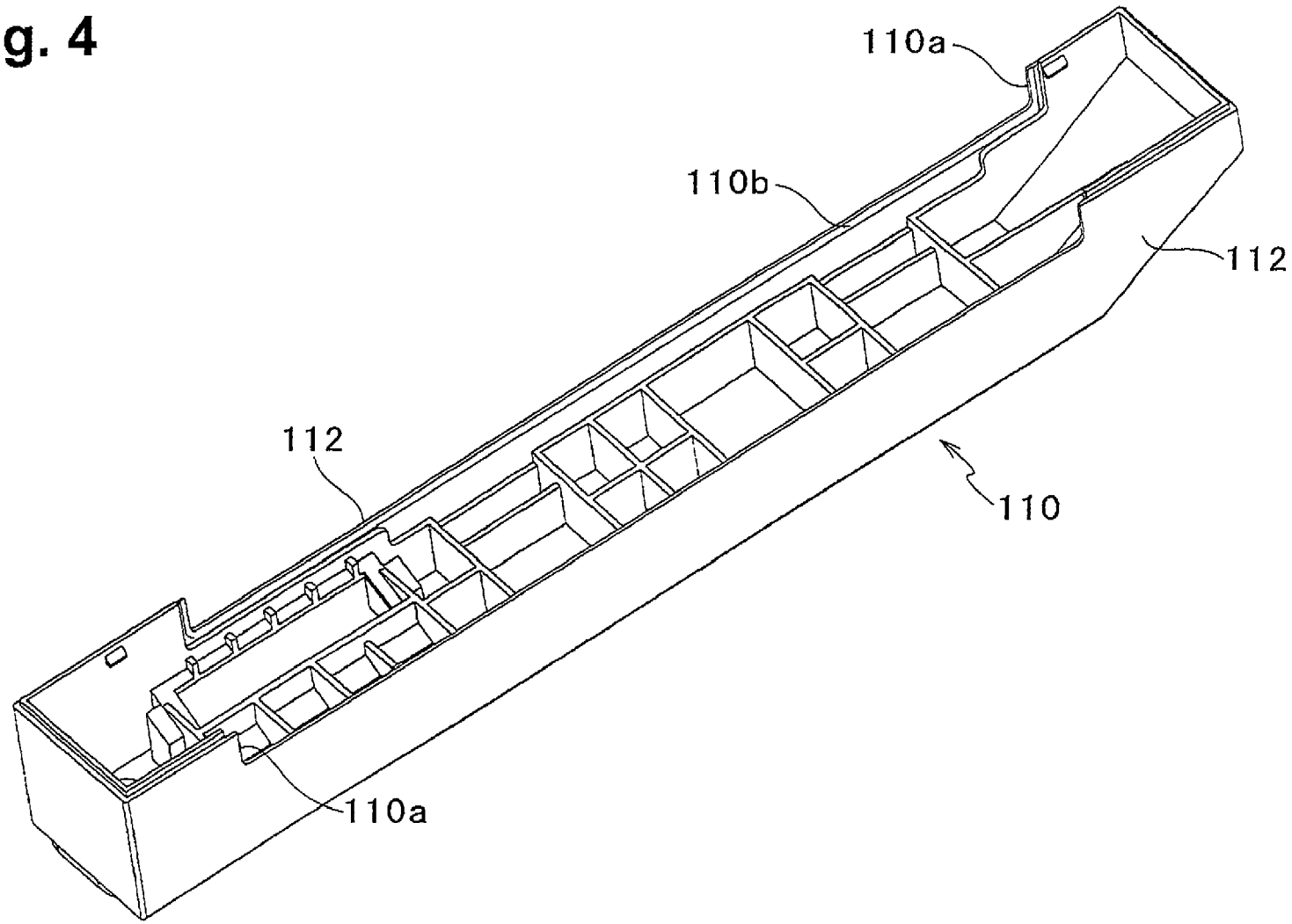
FIG. 4 is a perspective view of a head cover shown in FIG. 1, according to an embodiment of the invention.

As shown in FIGS. 1 and 4, head cover 110 may be substantially box shaped, and may open downward. Head cover 110 may be positioned to cover a space above flow path unit 140, and also may be positioned above a surface of flow path unit 140 on which actuator units 120 may be mounted. Ink supply valve 111 may be disposed on an upper surface of head cover 110, and ink may be supplied to ink reservoir 130 via ink supply valve 111.

Head cover 110 may include a plurality of sidewalls 112 facing each other in the sub scanning direction. Sidewalls 112 may have greater length in the main scanning direction than in an up and down direction, i.e., a vertical direction. Each sidewall 112 may be formed with a substantially rectangular-shaped opening 110*a* that may be elongated in the main scanning direction, at a lower edge of sidewall 112. Opening 110*a* may extend to substantially the midpoint of head cover 110 in a vertical direction. Opening 110*a* may be designed to expose a flat protrusion 150*a* formed in heat sink 150 from head cover 110. A cutout portion 110*b* may be formed on a portion of an inner wall surface of sidewall 112 along opening 110*a*. Each sidewall 112 may be formed with a recessed portion 112*a* on the inner wall surface so that sidewall 112 may be thin at recessed portion 112*a*. Upper end portion of heat sink 150 may be fitted in recessed portion 112*a*. Thus, heat sink 150 may be supported between sidewall 112 and flow path unit 140.

Figure 5:
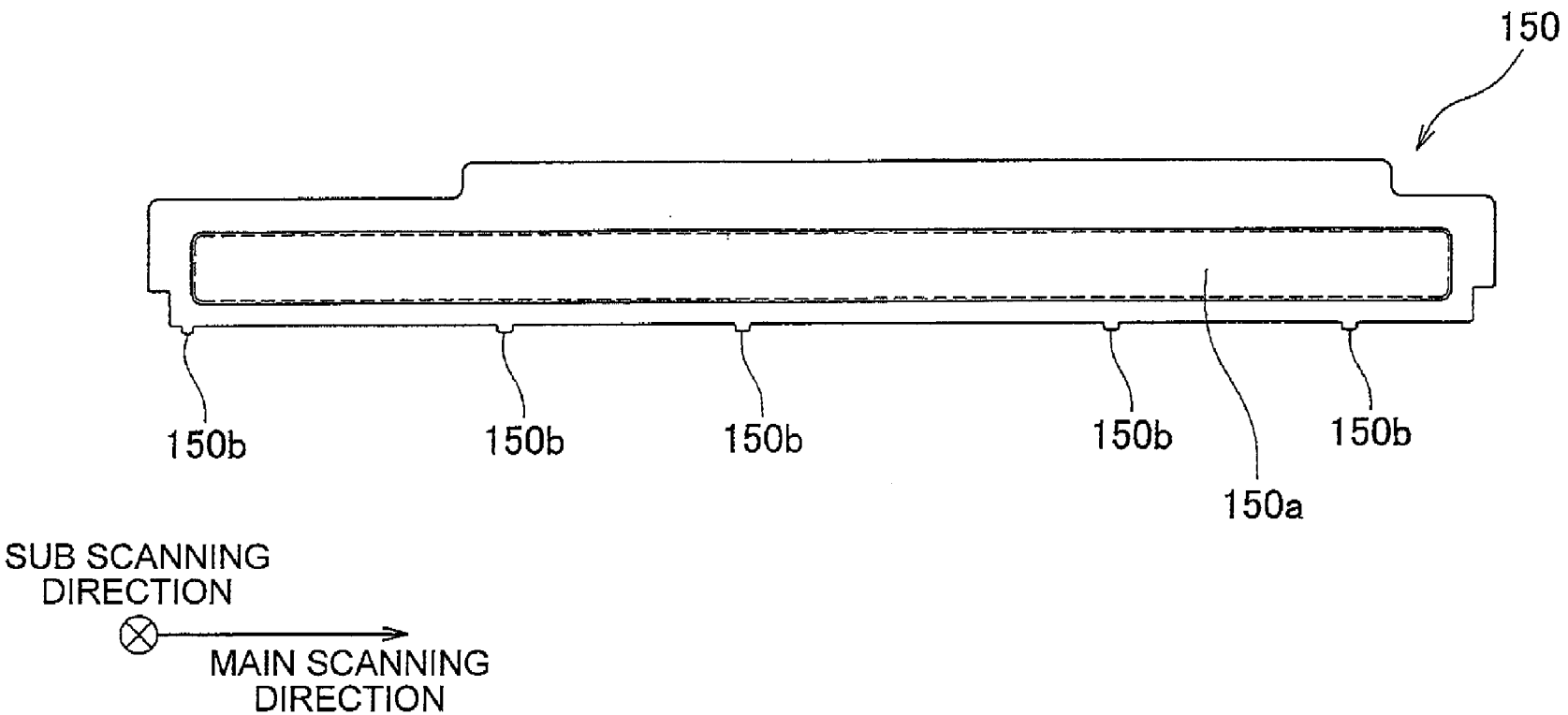
FIG. 5 is a side view of a heat sink shown in FIG. 1, according to an embodiment of the invention.

A heat sink 150 according to an embodiment of the invention may be shown in FIGS. 3 and 5. A plurality of heat sinks 150 may have a substantially rectangular shape, and may extend in the longitudinal direction, and also may extend in a direction opposite the ink ejection direction, of flow path unit 140. Flat protrusion 150*a* may be formed in a central portion of each heat sink 150. Flat protrusion 150*a* may protrude outward in the sub scanning direction. Flat protrusion 150*a* may be manufactured by deforming, e.g., stamping, a flat metal work piece. Flat protrusion 150*a* thus may be formed in heat sink 150, and may improve a stiffness of heat sink 150.

Each heat sink 150 may be formed with a plurality, e.g., five, of protrusions 150*b* protruding downward on a lower edge of heat sink 150. Protrusions 150*b* may be spaced in a longitudinal direction of heat sink 150. As shown in FIG. 3, a plurality of recessed portions 141 may be formed in proximity to both sides, with respect to the sub scanning direction, of the upper surface of flow path unit 140. As protrusions 150*b* may be engaged in recessed portions 141, heat sinks 150 may be positioned in proximity to both sides of the upper surface of flow path unit 140. The lower edge of each heat sink 150, except for the protrusions 150*b*, may tightly contact the upper surface of flow path unit 140, to prevent fluids, e.g., ink or ink mist, from entering inkjet head 1 from between heat sink 150 and flow path unit 140. In an embodiment of the invention, heat sinks 150 may be made of aluminum metal. Heat sinks 150 also may be made of other materials or combinations of materials, e.g., titanium metal, magnesium metal, titanium or magnesium alloy metal, aluminum alloy metal, or stainless steel.

Referring again to FIG. 3, each heat sink 150 may be positioned so that a perimeter of flat protrusion 150*a* on an outer surface of each heat sink 150 faces at least a portion of an inner surface of corresponding sidewall 112 of head cover 110. Cutout portion 110*b* may be formed at another portion of an inner surface, e.g., the lower edge of the inner wall surface, of sidewall 112. A gap may be created between cutout portion 110*b* and the outer surface of heat sink 150. The gap may be created along a boundary between heat sink 150 and sidewall 112, and may extend in a main scanning direction. The gap may be created along an entire end surface of sidewall 112, defining opening 110*a*. A sealing material, e.g., a potting material 156 may be applied along an entire length of the boundary. The applied potting material 156 may fill in the entire gap formed between heat sink 150 and cutout portion 110*b*. Potting material 156 may fill the gap entirely by capillary action. The potting material may have any viscosity which may facilitate capillary action, preferably having a viscosity of 5-20 pascals per second. Gaps between heat sinks 150 and flow path unit 140 are sealed with a potting material 155. Thus, a space enclosed by head cover 110, the heat sinks 150, and flow path unit 140 may be hermetically sealed.

According to an embodiment of the invention, the gap between heat sink 150 and cutout portion 110*b* may be filled with potting material 156, so that sidewall 112 of head cover 110 and corresponding heat sink 150 may adhere to each other tightly and stably. This structure may prevent fluid, e.g., ink or ink mist from entering the inkjet head 1, and potentially adhering to actuator 120. In addition, this structure may prevent the potting material 156 from escaping, e.g., being squeezed out, so that the sides of inkjet head 1 may be resistant to foreign objects, e.g., dust, debris, and dirt.

In an embodiment of the invention, a plurality, e.g., two, of heat sinks 150 may be positioned in proximity to both sides of flow path unit 140, with respect to the sub scanning direction. However, the number of heat sinks 150 is not limited to two. In other embodiments of the invention, one or more heat sinks may be positioned in proximity to the flow path unit.

In an embodiment of the invention, cutout portion 110*b* may be formed in each sidewall 112 of head cover 110, and may be configured to form a gap between sidewall 112 and heat sink 150. However, in another embodiment of the invention, cutout portion 110*b* may not be formed in each sidewall 112, but a cutout or a recess may be formed in an inner wall of heat sink 150, to form a gap between heat sink 150 and sidewall 112 of head cover 110.

In an embodiment of the invention, heat sinks 150 may be configured to dissipate heat of driver ICs 160. In another embodiment of the invention, heat sinks 150 may be side plates which may not function to dissipate heat. Although the embodiment of the present invention has been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. An inkjet head comprising:

a flow path unit comprising a first surface and a second surface opposite the first surface, wherein the flow path unit is configured to eject ink in an ink ejection direction;

an actuator positioned on the second surface, wherein the actuator is configured to generate ejection energy for ejecting ink;

a plurality of wall plates positioned on the second surface and extending away from the flow path unit in a direction opposite from the ink ejection direction, wherein at least one of the plurality of wall plates is a heat sink configured to transfer heat to an outside of the at least one of the plurality of wall plates;

a covering member contacting at least one of the plurality of wall plates, wherein the covering member is configured to cover a portion of the second surface of the flow path unit, and the covering member comprises a plurality of sidewalls, wherein a first portion of at least one of the plurality of sidewalls contacts a first portion of a corresponding one of the plurality of wall plates, and a second portion of the at least one of the plurality of sidewalls and a second portion of the corresponding one of the plurality of wall plates defines a gap therebetween; and a seal positioned in the gap, wherein the seal is configured to prevent fluid from entering the gap.

2. The inkjet head of claim 1, wherein the gap extends along an entire length of a boundary between each wall plate and the corresponding sidewall.

3. The inkjet head of claim 2, wherein the seal extends through the entire gap.

4. The inkjet head of claim 1, wherein the second portion of the at least one of the plurality of sidewalls comprises a recess which defines at least a portion of the gap.

5. The inkjet head of claim 1, wherein the second portion of the at least one of the plurality of wall plates comprises a recess which defines at least a portion of the gap.

6. The inkjet head of claim 1, wherein the second portion of the at least one of the plurality of wall plates comprises a first recess, and the second portion of the at least one of the plurality of sidewalls comprises a second recess, wherein the first and second recesses define at least a portion of the gap.

7. The inkjet head of claim 1, wherein the heat sink comprises aluminum metal, titanium metal, magnesium metal, stainless steel, or a titanium or magnesium alloy metal.

8. The inkjet head of claim 1, wherein the seal is positioned in the gap and held in place by capillary action.

9. The inkjet head of claim 1, wherein the seal comprises a material having a viscosity of 5-20 pascal seconds.

10. The inkjet head of claim 1, wherein the first portion of the at least one side wall is larger than the second portion of the at least one sidewall.

11. The inkjet head of claim 1, wherein the first portion of the at least one side wall is smaller than or the same size as the second portion of the at least one sidewall.

* * * * *